US005616088A

United States Patent [19]

Aizawa et al.

[11] Patent Number: 5,616,088

[45] Date of Patent: Apr. 1, 1997

[54] GOLF CLUB HEAD

[75] Inventors: Yuichi Aizawa, Hachioji; Yasuto Imai, Higashimurayama, both of Japan

[73] Assignee: Daiwa Seiko, Inc., Tokyo, Japan

[21] Appl. No.: 502,207

[22] Filed: Jul. 13, 1995

[30] Foreign Application Priority Data

Jul. 14, 1994 [JP] Japan ..... 6-162249

[51] Int. Cl.[6] ..... A63B 53/04

[52] U.S. Cl. ..... 473/341; 473/350

[58] Field of Search ..... 273/167 H, 172; 446/338, 339, 336, 337, 341, 345, 349, 350

[56] References Cited

U.S. PATENT DOCUMENTS

| | | | |
|---|---|---|---|
| 1,968,627 | 7/1934 | Young | 473/349 X |
| 2,517,245 | 8/1950 | Scott | 473/339 |
| 3,749,408 | 7/1973 | Mills | 473/336 |
| 4,340,230 | 7/1982 | Churchward | 473/339 |
| 4,607,846 | 8/1986 | Perkins | 273/167 H X |
| 4,653,756 | 3/1987 | Sato | 273/169 X |
| 4,872,684 | 10/1989 | Dippel | 473/336 X |
| 4,884,812 | 12/1989 | Nagasaki et al. | 273/169 X |
| 5,014,993 | 5/1991 | Antonious | 273/167 H X |
| 5,050,879 | 9/1991 | Sun et al. | 273/172 X |
| 5,411,264 | 5/1995 | Oku | 273/169 |
| 5,492,327 | 2/1996 | Biafore | 473/350 X |

FOREIGN PATENT DOCUMENTS

| | | |
|---|---|---|
| 59-82063 | 6/1984 | Japan . |
| 60-97158 | 7/1985 | Japan . |
| 323262 | 5/1991 | Japan . |

*Primary Examiner*—George J. Marlo
*Attorney, Agent, or Firm*—Longacre & White

[57] ABSTRACT

A golf club head capable of enhancing a moment of inertia and improving a directional stability of a ball. In the golf club head, a flange is formed on a peripheral portion of a back side of a head body, and projects rearwardly from the head body to thereby form a cavity in the back side, and a weight member, made of a material larger in specific gravity than the head body is secured within a recessed formed in outer peripheral surface of the flange. The weight is positioned at a top and a sole side of the head body so as to evenly distribute the weight over the outer peripheral surface of the flange.

10 Claims, 6 Drawing Sheets

GOLF CLUB HEAD

BACKGROUND OF THE INVENTION

This invention relates to an improved golf club head for enhancing a directional stability of a ball.

Generally, a head of an iron club is cast of metal such as soft iron or stainless steel, and a hosel portion, a sole portion, a face portion and so on are formed integrally with the club head. In this type of head, a sweet spot is enlarged by distributing the weight over a peripheral portion of a back side, and it is known that a moment of inertia is increased during the swing to enhance the directional stability of a ball.

Therefore, there has been proposed a golf club head as disclosed in Japanese Utility Model Examined Publication No. 3-23262 and shown in FIGS. 10 and 11, in which a weight member 3 of a horseshoe-shape, formed of a material greater in specific gravity than a head body 1, is secured to a peripheral portion of the head body 1. There has also been proposed a golf club head as disclosed in Japanese Utility Model Unexamined Publication No. 60-97158 and shown in FIGS. 12 and 13, in which a cavity (recess) 11 is formed in a back side 9 of a head body 7 except for a peripheral portion 10 thereof, and a weight member 15, made of a material greater in specific gravity than the head body 7, is secured to a step portion 13 formed in the back side of the peripheral portion 10.

However, in the head 17 shown in FIG. 10, although the weight member 3 is secured to the peripheral portion of the head body 1, the central portion of the head body 1 remains thick as shown in FIG. 11, and therefore the weight of the head 17 could not be sufficiently distributed over the peripheral portion of the back side.

In the latter head 19 shown in FIG. 12, the cavity 11 is formed in the back side 9 of the head body 7, and the weight member 15 is secured to the peripheral portion 10 of this back side. However, since the thickness of the head body 7 is increasing progressively toward a sole 21, the weight could not be sufficiently distributed over the peripheral portion of the back side 9 as is the case with the above conventional construction.

And besides, since the amount of projection of the peripheral portion 10 of the back side 9 is small, the weight member 15 can not be secured thereto in a large amount, and also in the construction in which the weight member 15 is secured to the back side of the peripheral portion 10, the weight could not be sufficiently distributed over the peripheral portion 10 of the back side 9. Thus, this and other problems have remain unsolved.

SUMMARY OF THE INVENTION

The present invention has been made under the circumstances, and an object of the invention is to provide a golf club head in which a moment of inertia possessed by the head is increased, thereby enhancing a directional stability of a ball.

To achieve the above object, the invention provides a golf club head in which a ,flange is formed on a peripheral portion of a back side of a head body, and projects rearwardly from the head body by an amount larger than a thickness of the flange to thereby form a cavity in the back side, and at least one weight member, made of a material larger in specific gravity than the head body, is secured to the flange.

The weight member is preferably secured to an outer peripheral surface of the flange.

Preferably, a face portion of the head body has a generally uniform thickness except for its peripheral portion corresponding to the flange.

In the golf club head of the invention, a pair of weight members may be secured respectively to those portions of the flange disposed respectively at a top side and a sole side of the head body. Alternatively, one weight member may be secured to the flange over an area including a top side, a toe side and a sole side of the head body.

Preferably, the thickness of the weight member is less that the length of the weight member to distribute the increased weight over the peripheral portion of the head.

In the golf club head of the invention, the flange formed on the back side of the head, as well as the weight member, distributes the weight of the head over the peripheral portion of the back side while increasing a mass of the golf club head.

Therefore, when hitting a ball with a golf club having the head, a flying distance of the ball is increased since a larger sweet spot is obtained as compared with the conventional construction, and besides the moment of inertia of the head increases during the swing, so that vibration of the head at the time of hitting the ball is reduced.

DETAILED DESCRIPTION OF THE PREFERRED EMBODIMENTS

Figure 1:
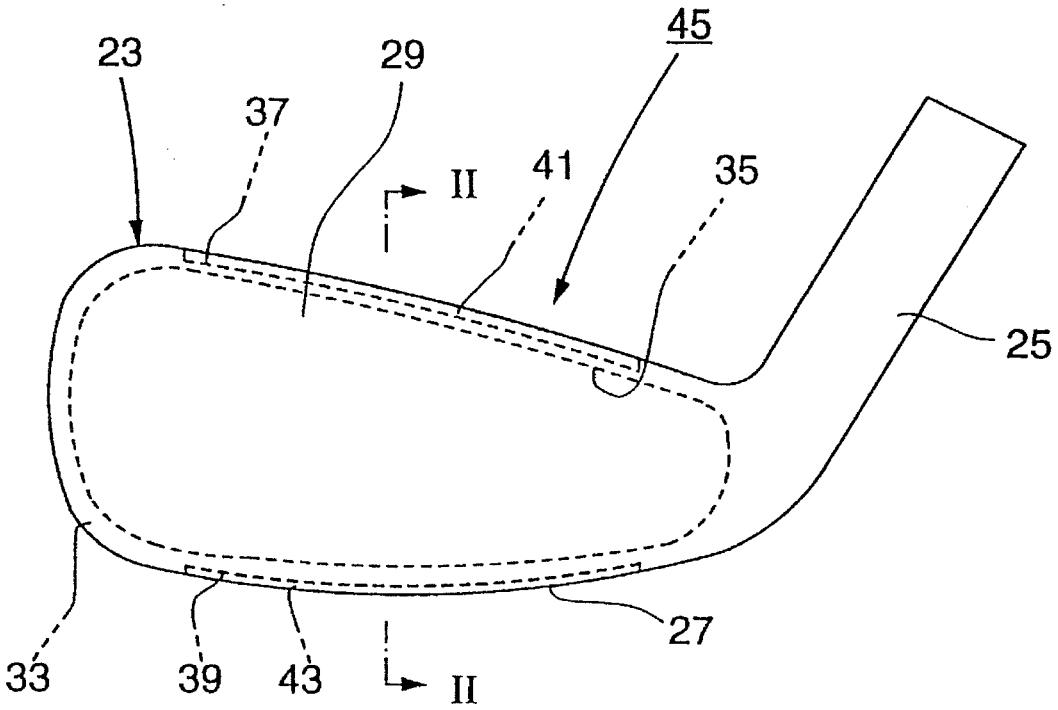
FIG. 1 is a front-elevational view of a preferred embodiment of a golf club head of the invention.

Preferred embodiments of the present invention will now be described with reference to the drawings.

FIGS. 1 to 4 shows one preferred embodiment of a golf club head of the invention. A metal head body 23 is cast of stainless steel or soft iron, and a hosel portion 25, a sole portion 27, a face portion 29 and so on are formed integrally with the head body 23 as in the conventional construction.

A flange 33 is formed on a peripheral portion of a back side 31 of the head body 23, and projects rearwardly from the head body 23 to form a cavity 35. The amount of projecting of the flange 33 rearwardly from the head body 23 is larger than the thickness of this flange 33. In contrast to the conventional construction shown in FIGS. 10 to 13, the thickness m of the face portion 29 of the head body 23 except for its peripheral portion (from which the flange 33 projects) is small and generally uniform.

Figure 2:
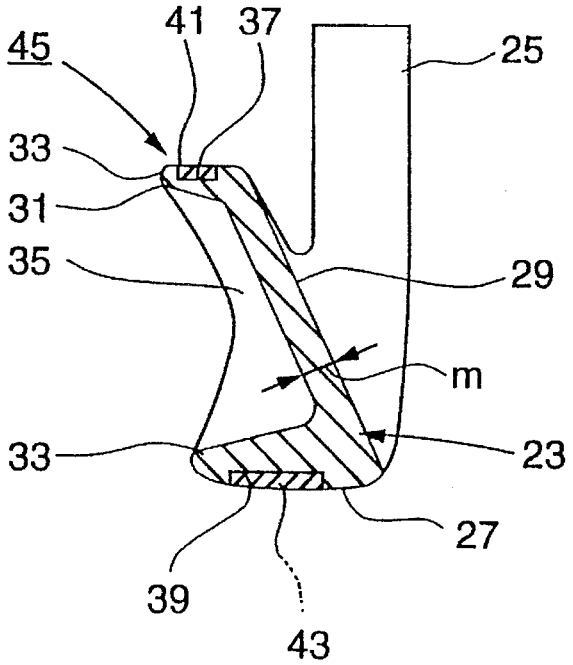
FIG. 2 is a vertical cross-sectional view taken along the line II—II of FIG. 1.
Figure 3:
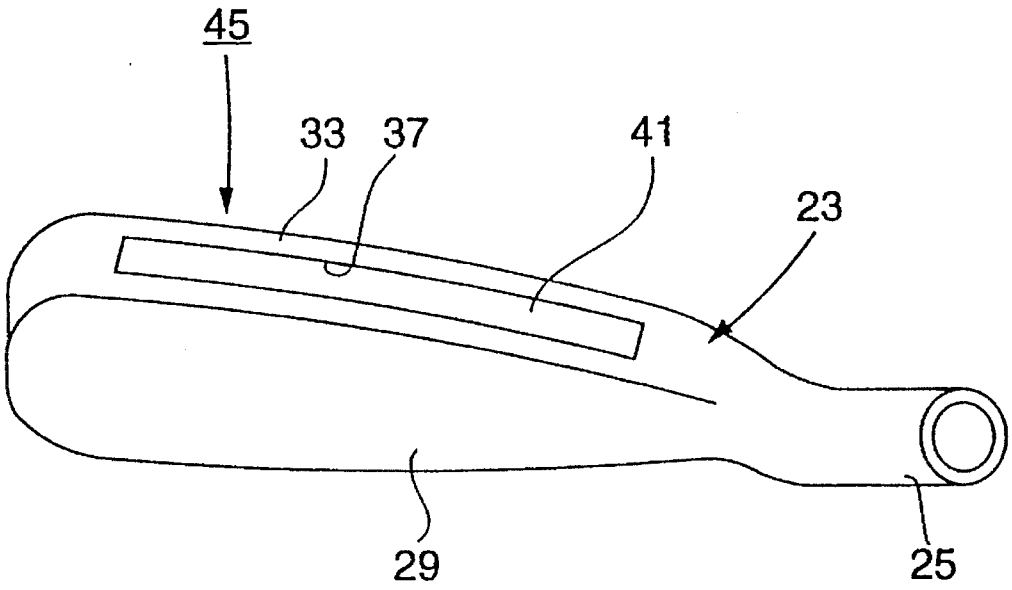
FIG. 3 is a plan view of the golf club head of FIG. 1.
Figure 4:
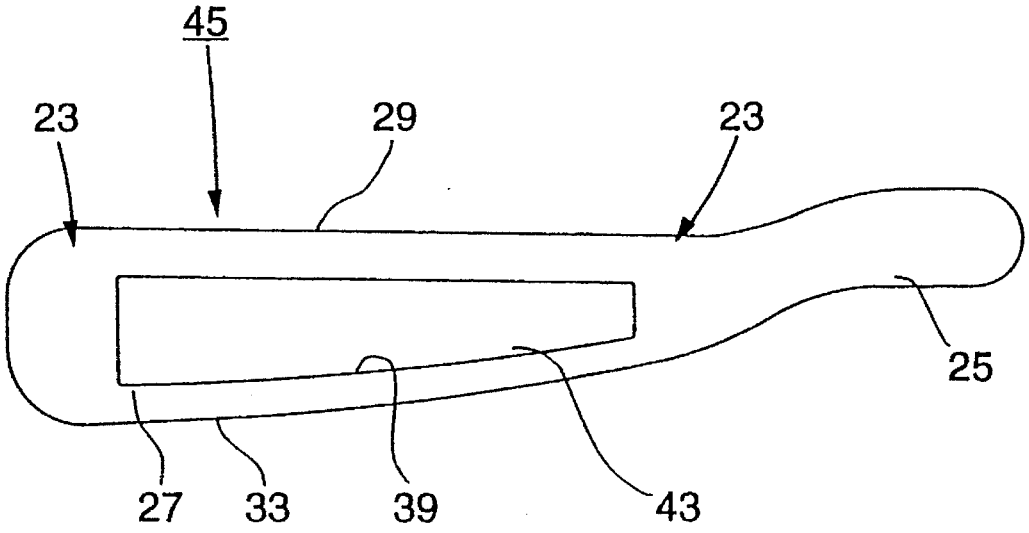
FIG. 4 is a bottom view of the golf club head of FIG. 1.
Figure 5:
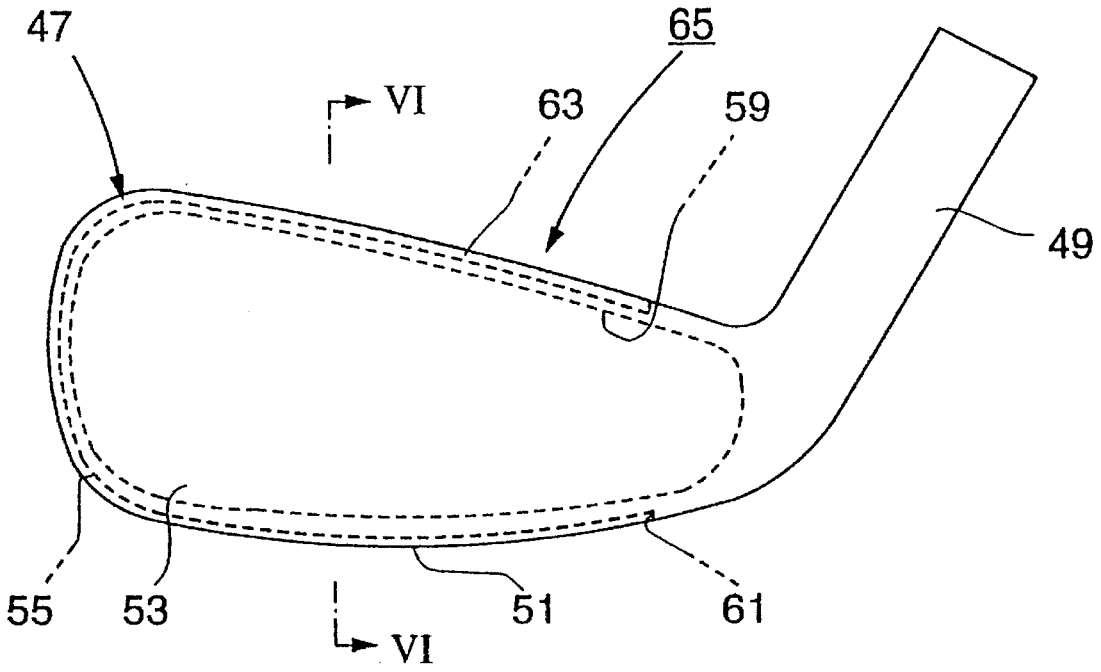
FIG. 5 is a front-elevational view of another preferred embodiment of a golf club head of the invention.

A recess 37 of a generally rectangular shape is formed in the outer peripheral surface of the flange 33 at the top side as shown in FIG. 3, and a recess 39 of a generally rectangular shape is formed in the outer peripheral surface of the flange 33 at the sole side as shown in FIG. 4. The recess 37 as well as the recess 39 extends from the heel side to the toe side. Weight members 41 and 43, made of a material greater in specific gravity than the head body 23, such as beryllium-copper, are fitted and mounted respectively in the recesses 37 and 39 in such a manner that an outer surface of each of the two weight members lies flush with the outer peripheral surface of the flange 33. The weight members 41 and 43 can be securely mounted to the recesses 37 and 39 by pressure-insertion, adhesive, or the like. In case the head body is formed of resin or there is a difference in melting point between materials of the head body 23 and the weight member 41, 43, the weight member 41, 43 can be fixed in place simultaneously when the head body is molded or cast. As shown in FIG. 2, each of the weight members 41 and 43 has a length in the projecting direction of the flange 33, larger than the thickness thereof.

Thus, in the head 45 of this embodiment, the flange 33 is formed on the peripheral portion of the back side 31, and projects rearwardly from the head body 23 to form the cavity 35 in such a manner that the amount of projecting of the flange 33 rearwardly from the head body 23 is larger than the thickness of this flange 33. The weight members 41 and 43, which are larger in specific gravity than the head body 23, are secured respectively to the top-side and sole-side portions of the outer peripheral surface of the flange 33. The thickness m of the face portion 29 is small and generally uniform, so that the thickness of the central portion of the head body 23 is reduced. With this construction, the flange 33 and the weight members 41 and 43 distribute the weight of the head 45 over the peripheral portion of the back side 31.

Therefore, when hitting a ball with a golf club having the head 45 mounted thereon, a flying distance of the ball is increased because of a larger sweet spot than that obtained with the conventional construction since the weight of the head 45 is positively distributed over the peripheral portion of the back side 31, and besides since the moment of inertia of the head 45 increases during the swing, vibration of the head 45 at the time of hitting the ball is reduced, so that the head 45 is made stable at the time of hitting the ball, thus advantageously providing an improved directional stability of the ball.

In this embodiment, the weight of the weight members 41 and 43 secured to the outer peripheral surface of the club can be suitably changed from one of a set of clubs to another, and therefore there can be achieved an advantage that the moment of inertia suitable for each club can be obtained.

FIGS. 5 to 9 shows another preferred embodiment of a golf club head of the invention. In these Figures, a head body 47 is cast of the same metal material as that of the above-mentioned head body 23, and a hosel portion 49, a sole portion 51, a face portion 53 and so on are formed integrally with the head body 47.

Figure 6:
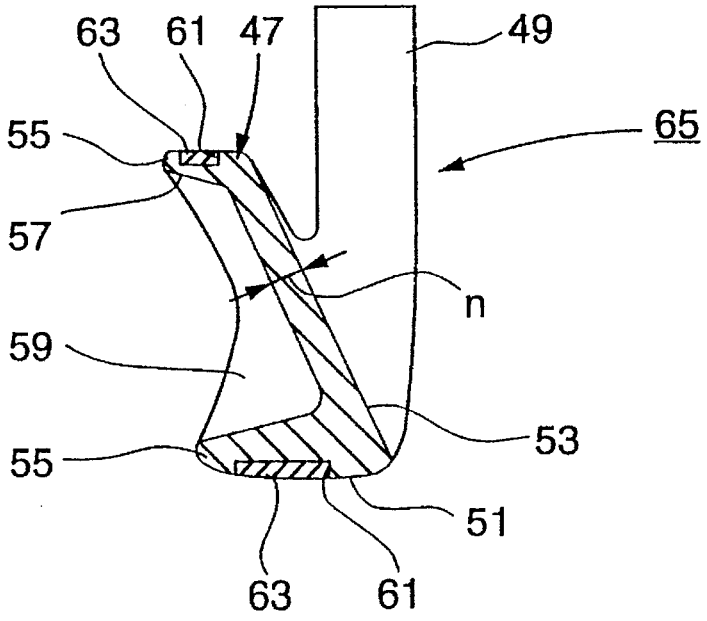
FIG. 6 is a vertical cross-sectional view taken along the line VI—VI of FIG. 5.
Figure 7:
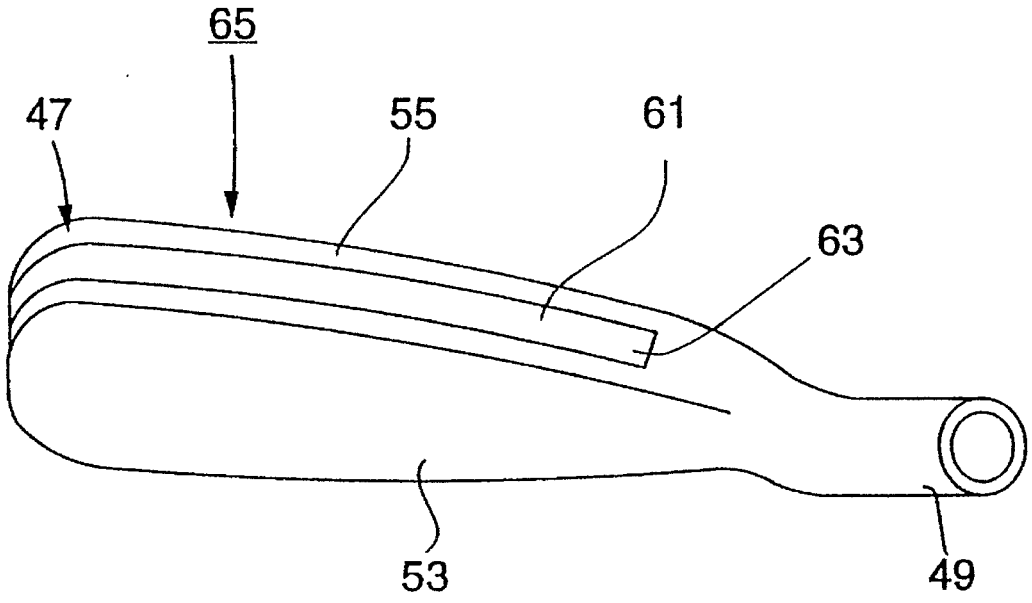
FIG. 7 is a plan view of the golf club head of FIG. 5.
Figure 8:
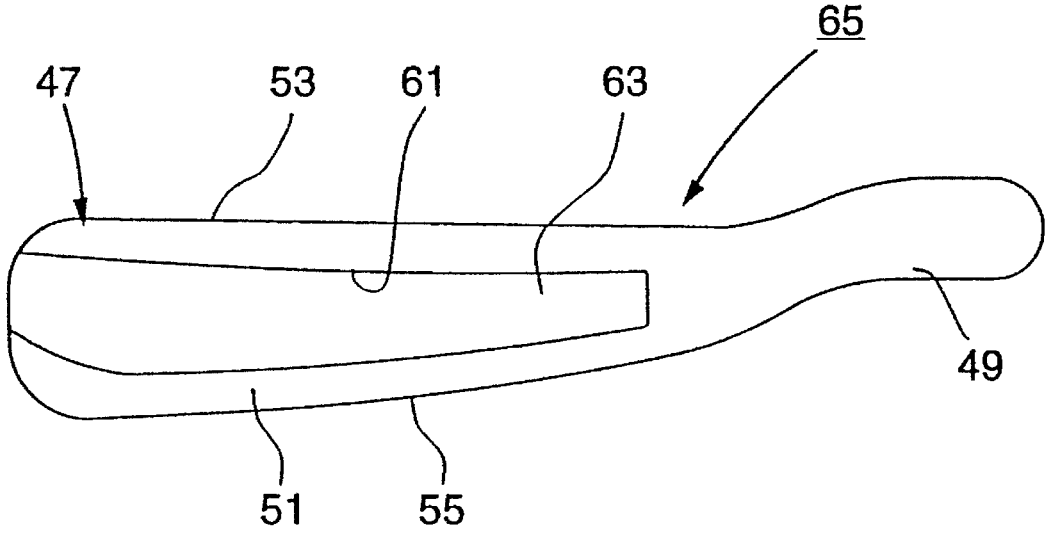
FIG. 8 is a bottom view of the golf club head of FIG. 5.
Figure 9:
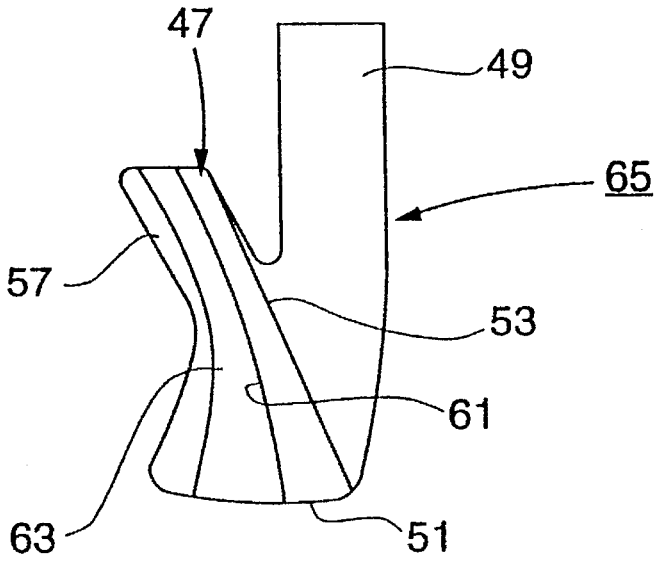
FIG. 9 is a side-elevational view of the golf club head of FIG. 5.
Figure 10:
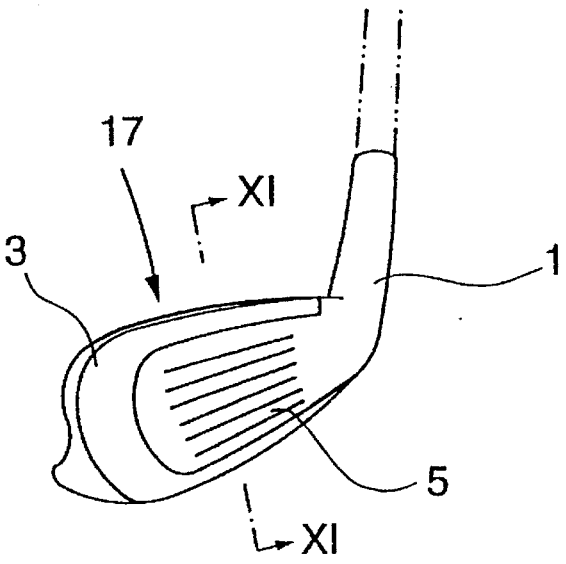
FIG. 10 is a perspective view of a conventional golf club head.
Figure 11:
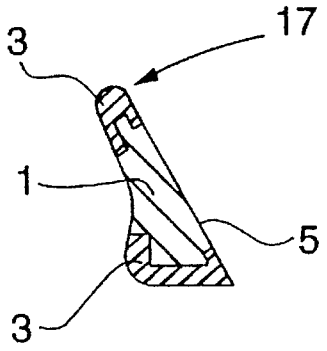
FIG. 11 is a cross-sectional view taken along the line XI—XI of FIG. 10.
Figure 12:
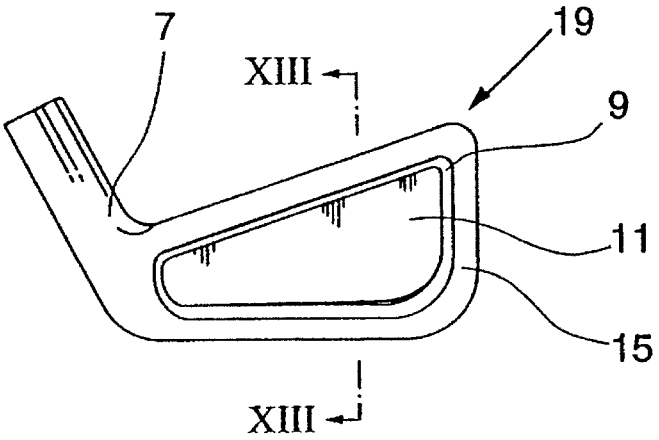
FIG. 12 is a rear view of another conventional golf club head.
Figure 13:
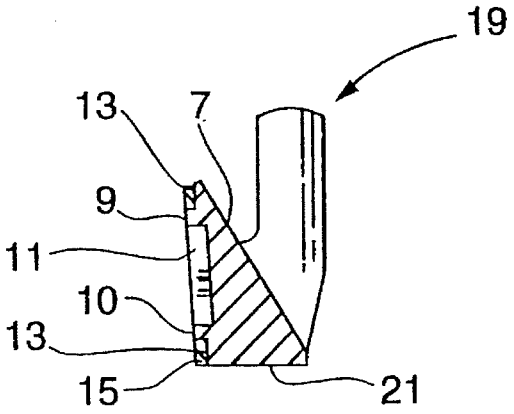
FIG. 13 is a cross-sectional view taken along the line XIII—XIII of FIG. 12.

In this embodiment, also, a flange 55 is formed on a peripheral portion of a back side 57 of the head body 47, and projects rearwardly from the head body 47 to form a cavity 59, and the amount of projecting of the flange 55 rearwardly from the head body 47 is larger than the thickness of this flange 55, as shown in FIG. 6. The thickness m of the face portion 53 of the head body 47 except for its peripheral portion (which corresponds to the flange 55) is small and generally uniform.

One continuous recess 61 is formed in the outer peripheral surface of the flange 55, and extends over an area including the top side, the toe side and the sole side. A generally horseshoe-shaped weight member 63 of beryllium-copper greater in specific gravity than the head body 47 is fitted and mounted in the recess 61 in such a manner that an outer surface of this weight member 63 lies flush with the outer peripheral surface of the flange 55, thus forming the head 65 of this embodiment.

Thus, in the head 65 of this embodiment, the flange 55 is formed on the peripheral portion of the back side 57, and projects rearwardly from the head body 47 to form the cavity 59 in such a manner that the amount of projecting of the flange 55 rearwardly from the head body 47 is larger than the thickness of this flange 55. The weight member 63, which is larger in specific gravity than the head body 47, is secured to the outer peripheral surface of the flange 55 over the area including the top side, the toe side and the sole side. The thickness m of the face portion 53 is small and generally uniform, so that the thickness of the central portion of the head body 47 is reduced. With this construction, the flange 55 and the weight member 63 distribute the weight of the head 65 over the peripheral portion of the back side 57.

When hitting a ball with a golf club having the head 65 mounted thereof, the intended purpose can be achieved as described above for the preceding embodiment since the weight of the head 65 is positively distributed over the peripheral portion of the back side 57. In this embodiment, however, since the weight member 65 is attached even to the toe side, a larger sweet spot is obtained as compared with the preceding embodiment, thereby increasing a flying distance of the ball, and besides since the moment of inertia of the head 65 increases during the swing, vibration of the head 65 at the time of hitting the ball is reduced, so that the head 65 is made stable at the time of hitting the ball, thus advantageously providing a more improved directional stability of the ball.

In this embodiment, also, by changing the amount of projecting of the flange 55 from one of a set of clubs to another and by suitably changing the weight of the weight member 63, secured to the outer peripheral surface of the flange, from one club to another, the moment of inertia suitable for each club can be obtained.

As described above, in the golf club head of the invention, the weight of the head is more positively distributed over the peripheral portion of the back side as compared with the conventional construction, and therefore when hitting a ball with a golf club having the head, a flying distance of the ball is increased since a sweet spot is larger as compared with the conventional construction, and besides since the moment of inertia of the head increases during the swing, vibration of the head at the time of hitting the ball is reduced, so that the head is made stable, thus advantageously providing a more improved directional stability of the ball.

In case the face portion has the generally uniform thickness and the thickness of the central portion of the head body is made thin, the weight of the head is more positively distributed over the peripheral portion of the back side. In case the weight member is attached even to the toe side of the flange, the weight of the head is more positively distributed over the peripheral portion of the back side.

In the golf club head of the invention, the amount of projecting of the flange, as well as the weight of the weight member secured to the outer peripheral surface of the flange, can be suitably changed from one of a set of iron clubs to another, and by doing so, the moment of inertia suitable for each club can advantageously be obtained.

What is claimed is:

1. A golf club head comprising;

a head body having a face side for hitting a ball, a back side opposite from said face side, a sole side and a top side;

a flange formed on a peripheral portion of said back side of said head body projecting backwardly from said head body, said flange having;

an outer peripheral surface having a width defined by a distance from said front face to said back side, said outer peripheral surface having at least one recess;

an inner peripheral surface defining a cavity in said back side; and a rear peripheral surface having a thickness defined by a distance from said outer peripheral surface to said inner peripheral surface, said width of said outer peripheral surface being greater than said thickness of said rear peripheral surface;

wherein at least one weight member having a specific weight and being made of a material larger in specific gravity than said head body, said at least one weight member being disposed in said at least one recess of said outer surface of said flange at a top and a sole side of said head body so as to distribute said weight over said outer peripheral surface of said flange.

2. A golf club head according to claim 1, wherein said head body has a generally uniform thickness between said face and back sides except for said peripheral portion from which said flange projects.

3. A golf club according to claim 1, wherein said at least one weight member comprises two weight members, one of said two weight members disposed at said top side of said head body and the other of said two weight members disposed at said sole side of said head body.

4. A golf club head according to claim 1, wherein said weight member is secured to said flange over an area including a top side, a toe side and a sole side of said head body.

5. A golf club according to claim 1, wherein a length of said weight member measured in a direction parallel to said width of said flange is larger than a thickness of said weight member measured in a direction parallel to said thickness of said flange.

6. A golf club head according to claim 1, wherein said flange is formed with a recess elongated from a toe side to a heel side with respect to said head body, and said weight member is securely fitted in said recess so as to be flush with a surface of said flange.

7. A golf club as recited in claim 1, wherein said at least one recess comprises one recess extending around said flange from said top side to said sole side.

8. A golf club as recited in claim 7, wherein said at least one weight member comprises one weight member extending around said flange from said top side to said sole side.

9. A golf club comprising:

a head body having a face side, a back side, and an outer peripheral surface disposed between said face side and said back side, said outer peripheral surface having at least two recess portions one disposed on a top side of said outer peripheral surface and a second recess formed at a sole side of said outer peripheral surface, said head body being made of a material having a specific gravity;

a recess formed in said back side of said head main body having an inner peripheral surface, a flange portion defined by said inner peripheral surface, said back side, and said outer peripheral surface, wherein a width of said flanged portion measured in a direction extending from said face side to said back side is greater than a thickness of said flange portion measured in a direction from said outer peripheral surface to said inner peripheral surface; and at least two weight members each having a specific gravity greater than said specific gravity of said head body, one of said at least two weight members being disposed in each of said at least two recess portions so as to lie flush with said outer peripheral surface, said at least two weight members being evenly distributed around said outer peripheral surface.

10. A golf club as recited in claim 9, wherein said at least two weight members is made of a beryllium/copper alloy.

* * * * *